US010451231B2

(12) United States Patent
Song et al.

(10) Patent No.: US 10,451,231 B2
(45) Date of Patent: Oct. 22, 2019

(54) OPTICAL DEVICE AND LIGHTING DEVICE COMPRISING THE OPTICAL DEVICE

(71) Applicant: SIGNIFY HOLDING B.V., Eindhoven (NL)

(72) Inventors: Gang Song, Shanghai (CN); Caijie Yan, Shanghai (CN)

(73) Assignee: SIGNIFY HOLDING B.V., Eindhoven (NL)

( * ) Notice: Subject to any disclaimer, the term of this patent is extended or adjusted under 35 U.S.C. 154(b) by 880 days.

(21) Appl. No.: 14/891,477

(22) PCT Filed: May 8, 2014

(86) PCT No.: PCT/IB2014/061279
§ 371 (c)(1),
(2) Date: Jan. 28, 2016

(87) PCT Pub. No.: WO2014/184718
PCT Pub. Date: Nov. 20, 2014

(65) Prior Publication Data

US 2018/0306394 A1 Oct. 25, 2018

Related U.S. Application Data

(63) Continuation of application No. PCT/CN2013/000583, filed on May 15, 2013.

(51) Int. Cl.
*F21S 8/00* (2006.01)
*F21V 5/04* (2006.01)
(Continued)

(52) U.S. Cl.
CPC ..... *F21S 8/037* (2013.01); *F21V 5/04* (2013.01); *F21V 7/0091* (2013.01);
(Continued)

(58) Field of Classification Search
CPC ..... F21S 8/037; F21V 5/04; F21V 7/0091; F21V 33/006; F21Y 2115/10; F21W 2111/027
See application file for complete search history.

(56) References Cited

U.S. PATENT DOCUMENTS 5,430,627 A 7/1995 Nagano
6,685,332 B1 2/2004 Clark
(Continued)

FOREIGN PATENT DOCUMENTS

EP 1239217 A2 9/2002
WO 2003049971 A1 6/2003
WO 2010067991 A1 6/2010

*Primary Examiner* — Mary Ellen Bowman

(57) ABSTRACT

The present invention discloses an optical device (100) and a lighting device for illuminating two intersecting surfaces (S1, S2). The optical device (100) comprises a first light guiding structure (120) for redirecting light from a light source (200) into a first direction and a second light guiding structure (130) for redirecting light from the light source (200) into a second direction different from the first direction, wherein the optical device (100) is arranged to prevent light from the light source (200) from being redirected in a direction between the first and second directions. By positioning the lighting device (100) at the intersection of two surfaces (S1, S2) such as can be found in a step, or at a corner of a wall, or at a corner inside a closet, or on the intersection area of ceilings, the two intersecting surfaces can be illuminated at the same time with comfortable light distribution, using a simple structure that can be easily installed.

8 Claims, 5 Drawing Sheets

(51) Int. Cl.

| | |
|---|---|
| ***F21V 7/00*** | (2006.01) |
| ***F21V 33/00*** | (2006.01) |
| ***F21Y 115/10*** | (2016.01) |
| ***F21W 111/027*** | (2006.01) |

(52) U.S. Cl.
CPC ..... *F21V 33/006* (2013.01); *F21W 2111/027* (2013.01); *F21Y 2115/10* (2016.08)

(56) References Cited

U.S. PATENT DOCUMENTS

| | | | | |
|---|---|---|---|---|
| 2002/0105800 | A1 | 8/2002 | Tufte | |
| 2008/0084693 | A1 | 4/2008 | Shimada et al. | |
| 2008/0205054 | A1 | 8/2008 | Ho | |
| 2010/0109034 | A1 | 5/2010 | Bierhuizen et al. | |
| 2011/0141744 | A1* | 6/2011 | Chang ..... | F21V 1/00 362/297 |
| 2012/0051066 | A1 | 3/2012 | Koo et al. | |

* cited by examiner

OPTICAL DEVICE AND LIGHTING DEVICE COMPRISING THE OPTICAL DEVICE

CROSS-REFERENCE TO PRIOR APPLICATIONS

This application is the U.S. National Phase application under 35 U.S.C. § 371 of International Application No. PCT/IB2014/061279 filed on May 8, 2014, which claims the benefit of Application No. PCT/CN2013/000583, filed on May 15, 2013. These applications are hereby incorporated by reference herein.

TECHNICAL FIELD OF THE INVENTION

This invention relates to the field of optics, in particular, to an optical device and a lighting device with such an optical device for illuminating two intersecting surfaces.

BACKGROUND OF THE INVENTION

As everyone must have experienced, it is difficult to recognize steps when climbing stairs in the dark and the consequence could be serious if you miss a step. The conventional way to improve the safety is to install a luminaire inside a recession of the side wall of a step, so that the top surface of the lower step can be illuminated. However, the vision difference caused by the illuminated top surface of a lower step and the un-illuminated side surface of an upper step, and the uncomfortable light distribution still would cause trouble to passers. See FIG. 1, which shows an outdoors step luminaire with the conventional structure. In addition, another shortcoming of the conventional way lies in the necessity of opening a recession on the side surface of steps, which in turn costs a lot and complicates installation.

Unlike the conventional way described above, U.S. Pat. No. 5,430,627 proposed another lighting fixture with dual-channel units and without the need of opening a recession for purpose of illuminating both a step tread and a step riser. As a cross-section view of the disclosed device, FIG. 2 shows that channel 29 and channel 35 are provided to accommodate two light strings in order to illuminate the top edge and the base of a step, respectively. However, one problem with this type of device is that to simultaneously illuminate the top edge and base of a step, two sets of separate light strings have to be provided, which correspondingly need extra structure and therefore make the device large and complex. Another problem with this type of device is that since there is no light distribution design, as the conventional way above does, the luminance level on the top surface is not uniform; what is worse is that the light distribution for illuminating the top edge of a step will also emit upward to passers' eyes, which is undesirable.

It is an object of the invention to provide an optical device that can be used in a lighting device in order to at least reduce some of the aforementioned drawbacks.

SUMMARY OF THE INVENTION

In a first aspect of the invention, the object is achieved by an optical device for positioning at or adjacent to an area where a first surface intersects a second surface, and for redirecting light from a light source.

According to the present invention, the optical device comprises a bottom surface under which the light source can be positioned, a first light guiding structure for redirecting light from the light source into a first direction towards the first surface, and a second light guiding structure for redirecting light from the light source into a second direction (different from the first direction) towards the second surface, wherein the optical device is arranged to prevent light from the light source from being redirected in a direction between the first and second directions.

The optical device of the invention is capable of delivering uniform light distribution. Furthermore, it is relatively small in size, less complex, and arranged to be easily installed.

In an embodiment of the optical device according to the present invention, the first and second directions have an enclosed angle of more than 90 degrees and less than 180 degrees.

In an embodiment of the optical device according to the present invention, the optical device may comprise a third light guiding structure for redirecting light from the light source into a third direction different from the first and second directions, wherein the optical device is arranged to prevent light from the light source from being redirected in a direction between the first, the second and the third directions.

In an embodiment of the optical device according to the present invention, at least two light guiding structures may be provided asymmetrically structurally with respect to an optical axis of the light source.

In an embodiment of the optical device according to the present invention, each of the first light guiding structure and the second light guiding structure comprises a curved surface and an end surface, wherein the light from the light source may be reflected by the curved surface and redirected out of the optical device through the end surface. In this embodiment, the curved surface may be a parabolic or concave surface.

In a second aspect of the invention, the object is achieved by a lighting device for illuminating the area where at least two surfaces intersect, wherein the lighting device comprises the optical device according to the first aspect of in the invention and a light source, and wherein the light source is located under the bottom surface of the optical device. In an embodiment of the lighting device according to the invention it further comprises a control component to control the light source. In this embodiment the control component may be connected locally or remotely to the lighting device.

By positioning the lighting device at the intersection of two intersecting surfaces, for example at a step, or at a corner of a wall, or at a corner inside a closet, or on the intersection area of ceilings, the two intersecting surfaces can be illuminated at the same time. For example, when installing the lighting device at the intersection of a step, there is no need to open a recession on the side wall of the steps; more than that, at least two light guiding structures can be provided towards the side wall and the base surface of the steps simultaneously, which can greatly increase the safety for people climbing stairs at dark. One more example is a gallery where only a corner area needs to be highlighted; especially the three intersecting walls of the corner, a lighting device with three light guiding structures can achieve the purpose.

BRIEF DESCRIPTION OF DRAWINGS

Embodiments of the present invention will be described in the sense of examples and their advantages are explained in greater details below, with reference to the accompanying drawings.

Throughout the figures, same or similar reference numbers indicate same or similar elements.

DETAILED DESCRIPTION OF EMBODIMENTS

Hereinafter, the principle and spirit of the present invention will be described with reference to the illustrative embodiments. It should be understood that all these embodiments are given merely for the skilled in the art to better understand and further practice the present invention, but not for limiting the scope of the present invention. In the interest of clarity, not all features of an actual implementation are described in this specification.

Figure 1:
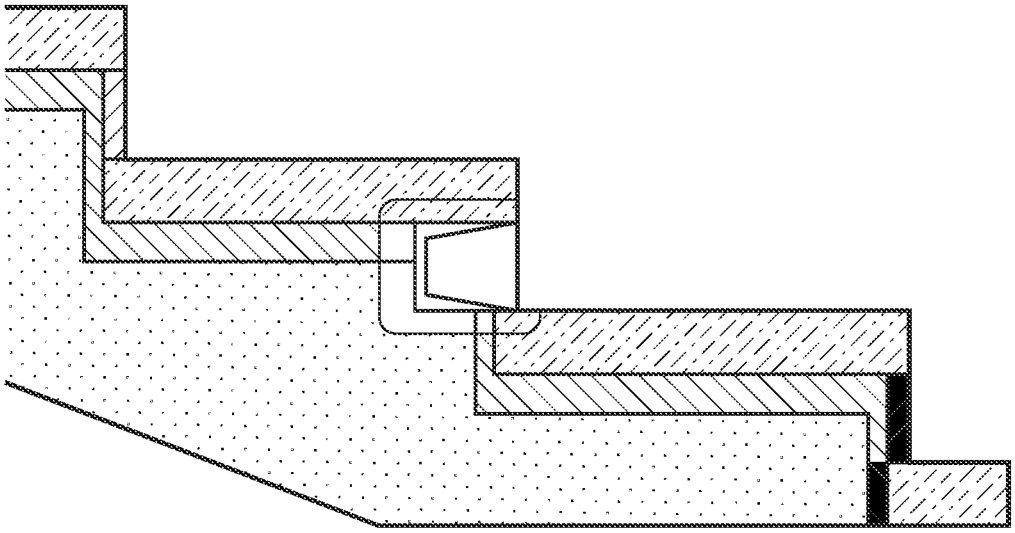
FIG. 1 shows a conventional step light.
Figure 2:
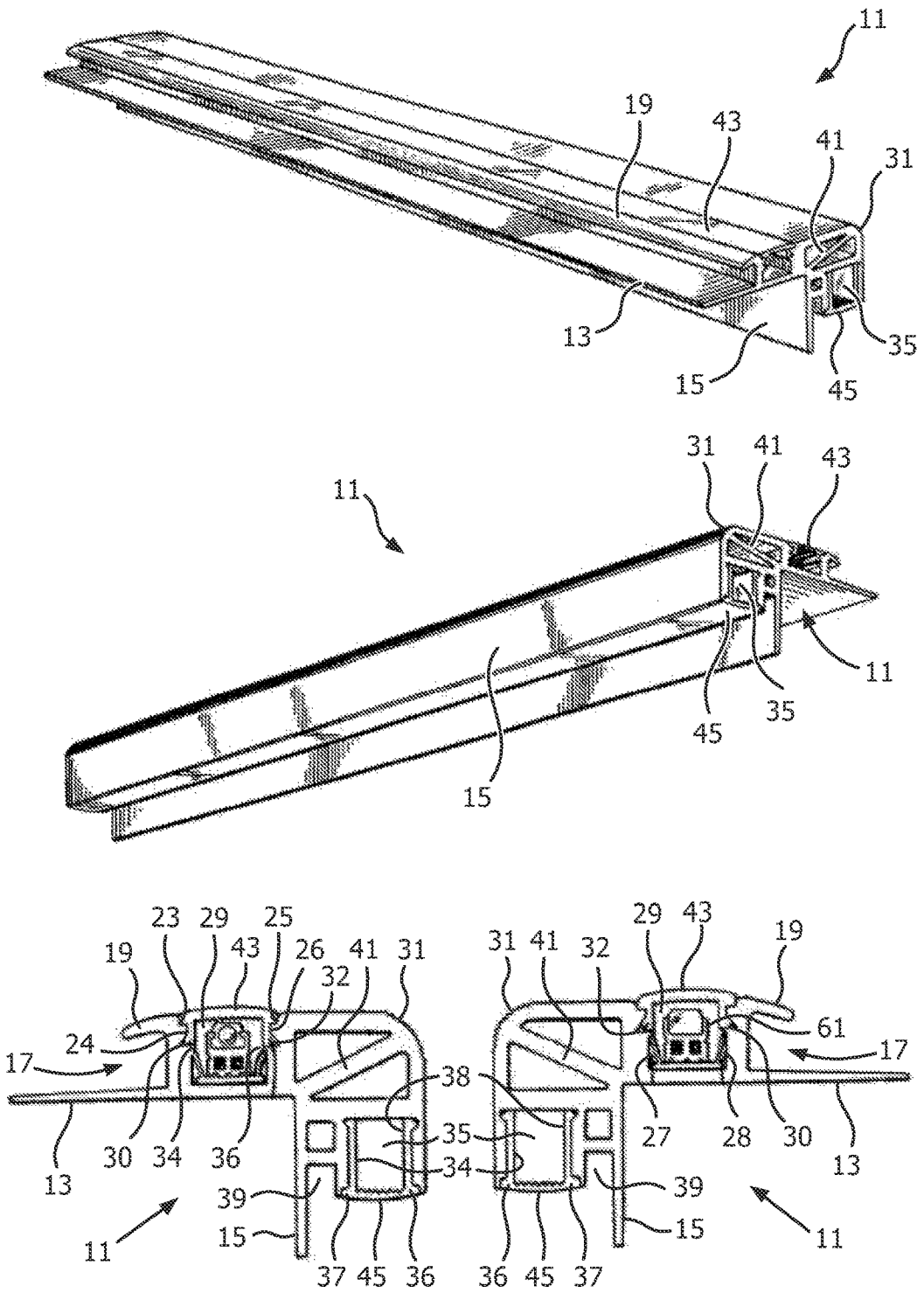
FIG. 2 shows an existing lighting fixture as disclosed in U.S. Pat. No. 5,430,627.
Figure 3:
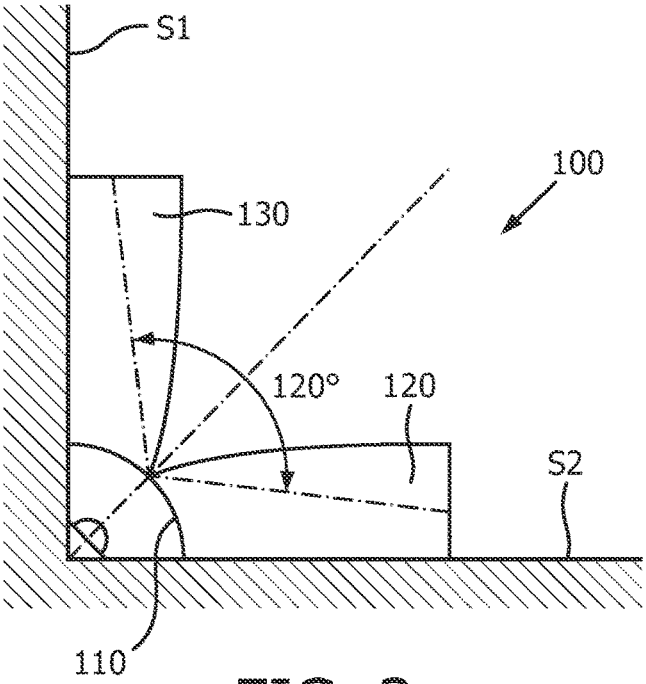
FIG. 3 shows a cross section of an optical device according to an embodiment of the present invention.
Figure 4:
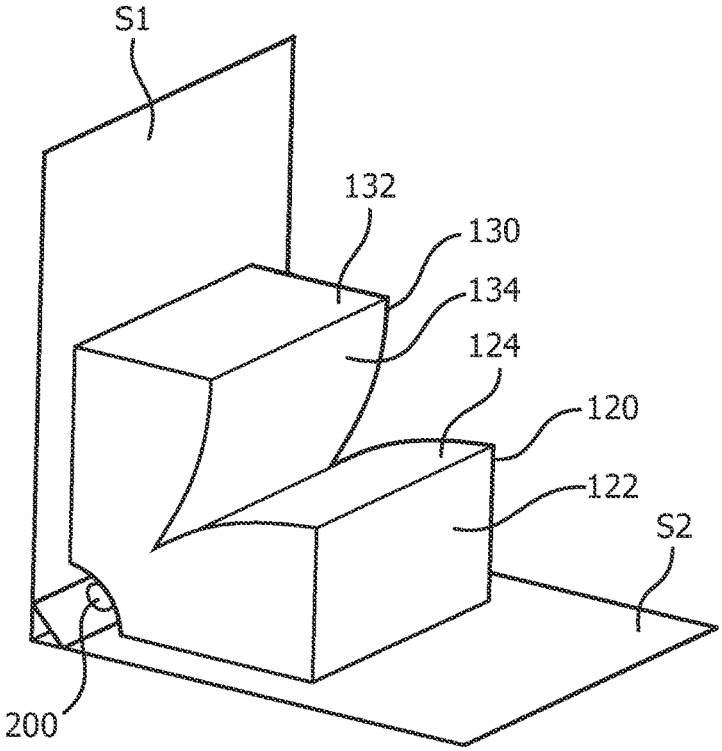
FIG. 4 shows a three dimensional view of FIG. 3

FIG. 3 and FIG. 4 show an embodiment of an optical device according to the present invention. As the figures show, the optical device 100 comprises a bottom surface 110, and two light guiding structures 120 and 130 for positioning at the area of two intersecting surfaces S1 and S2, and for redirecting lights from a light source 200 to two different directions, and the two directions have an enclosed angle of about 120°. In this embodiment, the bottom surface 110 can take the shape of a hemi-cylinder or a hemisphere to receive the light source, such as a LED.

Referring to FIG. 3 and FIG. 4, light guiding structure 120 comprises an end face 122, a base surface (do not have the reference number) extending from the bottom surface of the optical device 100 to the end face 122, two parallel side faces (do not have the reference number), and a curved surface 124, which functions as a TIR reflector and is configured to allow light emitted from a light source to reflect on its inner wall and to make the reflected light beams pointing at a targeted area, that is the horizontal surface S1 here. In this embodiment, the end face 122 is perpendicular to the two side faces. However, the shape or angle of the end faces of the light guiding structures may be different to fit different situations; for example, the end face can take the shape of a circle, instead of a rectangle as the Figures show; the angle of the end face with respect to the side face of the structures 1 may be any other angles (no drawings are made for this variation). In the similar way, the other light guiding structure 130 also comprises an end face 132, a base surface, two parallel side faces, and a curved surface 134, on which the light emitted from the light source 200 reflects and then redirected to another targeted surface S2. In this embodiment, the two curved surfaces 124 and 134 show the shape of a concave and are connected directly. In other embodiments, the curved surface may show different shapes other than a concave. The two light guiding structures are provided symmetrical with respect to the optical axis in this embodiment, and therefore the light source is positioned at the corner.

As the figures shows, the two light guiding structures 120 and 130 extend right from the top wall of the bottom surface 110 towards two totally different directions; by coating materials with reflectance on the inner wall of surfaces of the two light guiding structures, the light from a light source can be prevented from being redirected to the direction between the two different directions. Each light guiding structure, 120 and 130, ends up with an end face 122 and 132, respectively, wherein the end face 122 is vertical to the horizontal plane and the other end face 132 is parallel to the horizontal plane. Depending on which area or surface should be illuminated or highlighted, the light beams will be directed towards that area or surface through the end face of corresponding light guiding structures.

Figure 5:
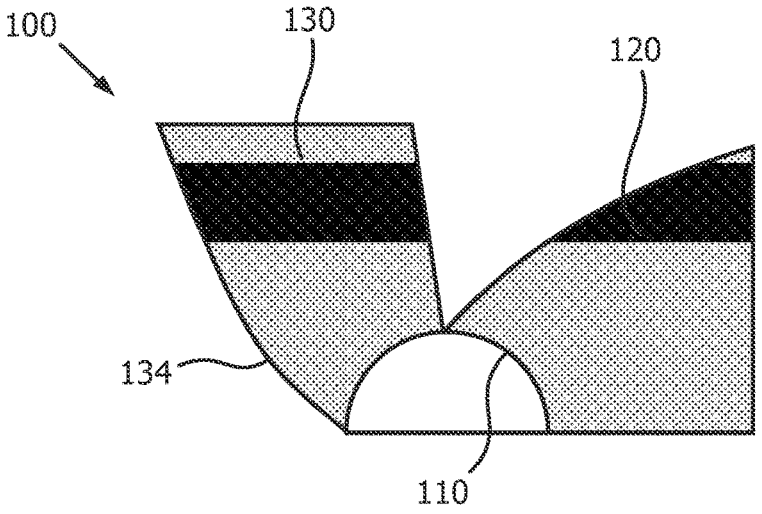
FIG. 5 shows a cross section of an embodiment of an optical device with asymmetrical structures.
Figure 6:
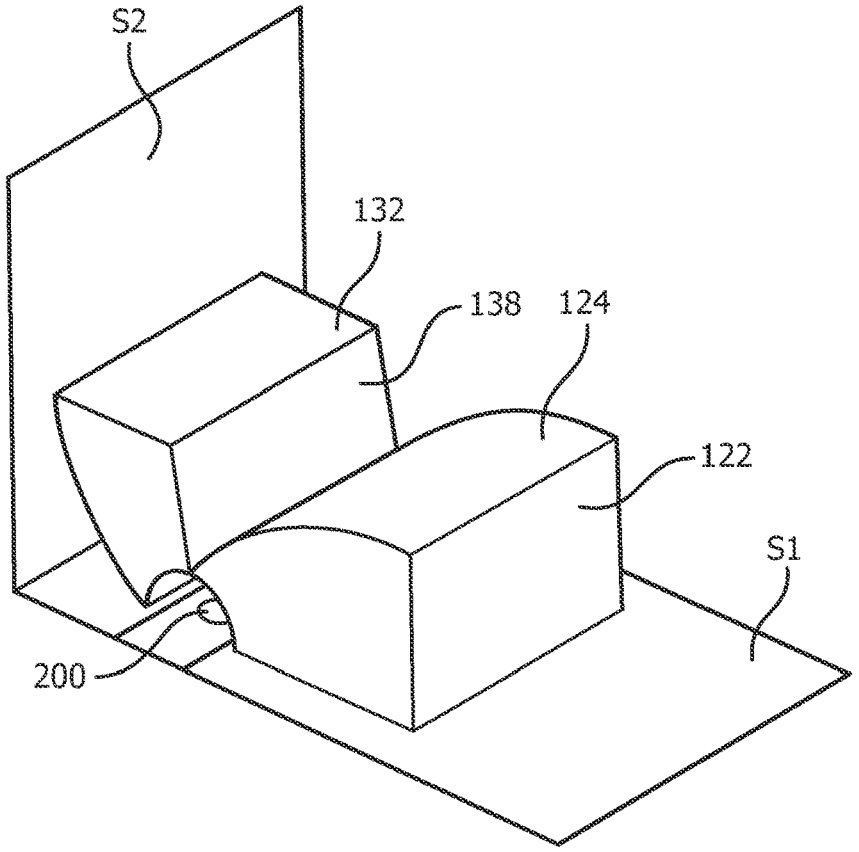
FIG. 6 shows a three dimensional view of FIG. 5

FIG. 5 and FIG. 6 shows a different embodiment of an optical device, wherein FIG. 6 is the three dimensional view of FIG. 5. Relative to the optical axis of a light source that is provided under the bottom surface of the optical device, the two light guiding structures 120 and 130 are designed asymmetrically, wherein in this embodiment, the angle of the two light guiding structures with the optical axis is different, the length of the light guiding structures is different, and the curvature of the component curved surfaces (124, 134) of the two light guiding structures is different; accordingly, the light beams exiting out of the two light guiding structure are asymmetrical with respect to the optical axis, which means the light beams would not distribute in a same shape or in a same direction or in a same angle with regard to the optical axis. As FIG. 5 and FIG. 6 show, the curved surface 134 isn't set connected with the other curved surface 124; instead, an inclined surface 138 of the light guiding structure 130 is connected with the curved surface 124 of the light guiding structure 120. Therefore, it can be seen that the curved surface of the light guiding structures may be provided at different positions and with different curvatures. Similarly, when the light guiding structures are set asymmetrically, the angle, length, and the number of the curved surfaces of the light guiding structures may be varied. In this embodiment, the enclosed angle of the two light guiding structures is about 135°; a light source may be placed on the horizontal surface S1, as FIG. 6 shows, or on the vertical surface S2 (not shown).

Figure 7:
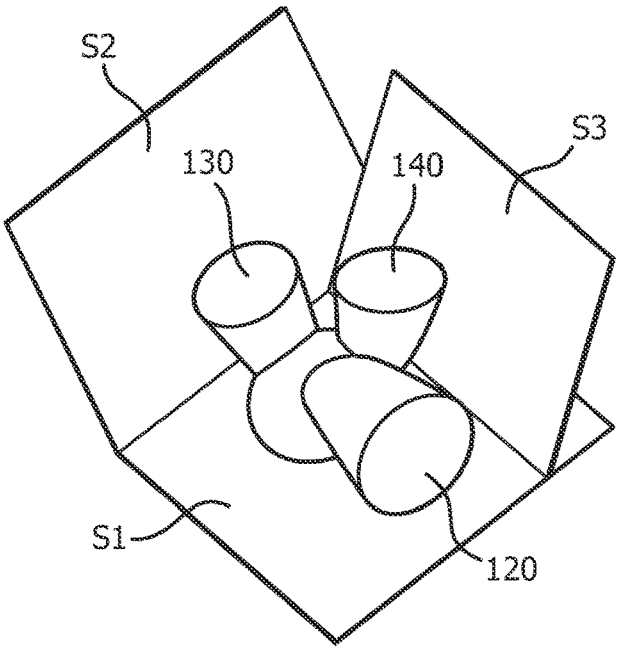
FIG. 7 shows another embodiment of the present invention with three light guiding structures.

FIG. 7 shows another embodiment of the present invention, wherein three light guiding structures are provided to illuminating three intersecting surfaces S1, S2 and S3. As FIG. 7 shows, the three structures 120, 130 and 140, respectively extend from the bottom surface of the optical device towards three surfaces S1, S2 and S3, wherein the bottom surface shows the shape of a hemisphere. In this embodiment with more than three structures, the three structures may be all made symmetrical with one another relative to the optical axis, or may be made asymmetrical with respect to the optical axis in terms of the curvature of their curved surface, length of the structure, angle with the optical axis. Structure 120 and 130 are angled with 150°; 130 and 140 are angled with 95°; 120 and 140 are angled with 105°. Via reflection at the curved faces of each light guiding structure, the light will reach the targeted areas through the end face of the each structure. The lighting device with this type of optical device can be positioned at a corner, like a wall corner or a closet corner.

Figure 8:
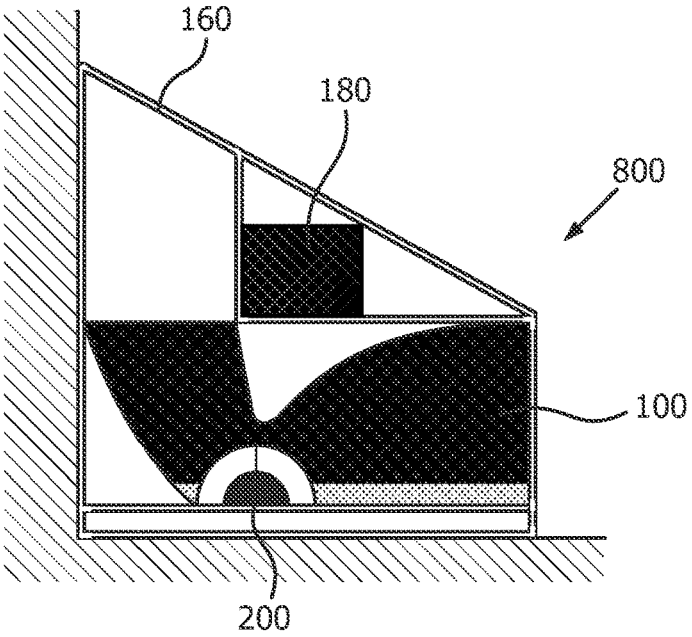
FIG. 8 shows another embodiment, wherein a control component is locally connected to the lighting device.

According to an embodiment of the present invention, as FIG. 8 shows, a lighting device 800 comprises an optical device 100, a LED lighting source 200 positioned under the bottom surface of the optical device 100, a housing 160 to cover the optical device, and a control component 180 to control the LED light source. The control component 180 could be provided either inside the housing or installed above the housing as FIG. 7 shows, or provided remotely somewhere in order to reduce the size of the whole lighting device (not shown). The LED lighting source installed under the optical device may be a packaged product comprising one or more LED chips.

It is believed that the following claims particularly point out certain combinations and sub-combinations that are directed to one of the disclosed inventions and are novel and non-obvious. Inventions embodied in other combinations and sub-combinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

The invention claimed is:

1. An optical device for positioning at or adjacent to an area where a first surface intersects a second surface and for redirecting light from a light source, the optical device comprising a bottom surface under which the light source can be positioned, wherein the optical device further comprises:

a first light guiding structure having a first end face and a first curved surface, whereby the first light guiding structure functions as a TIR reflector that is configured for redirecting light from the light source into a first direction towards the first surface, and a second light guiding structure having a second end face and a second curved surface, whereby the second light guiding structure functions as a TIR reflector that is configured for redirecting light from the light source into a second direction towards the second surface, wherein the optical device is arranged to prevent light from the light source from being redirected in a direction between the first and second directions, and wherein the first end face of the first light guiding structure is parallel to the first surface, and the second end face of the second light guiding structure is parallel to the second surface.

2. The optical device according to claim 1, wherein the first and second directions have an enclosed angle larger than 90 degrees and less than 180 degrees.

3. The optical device according to claim 1, wherein the first and second curved surfaces include a concave surface.

4. The optical device according to claim 1, wherein the first and second light guiding structures are provided asymmetrically with respect to an optical axis of the light source.

5. The optical device according to claim 1, wherein a third surface intersects the first and second surfaces at the area; the optical device further comprises a third light guiding structure for redirecting the light from the light source into a third direction towards the third surface, and the third direction is different from the first and second directions, and wherein the optical device is arranged to prevent light from the light source from being redirected in a direction between the first, the second and the third directions.

6. A lighting device comprising a light source and the optical device according to claim 1.

7. The lighting device as according to claim 6, further comprising an electronic control component for controlling the light source, wherein the electronic control component is either locally or remotely connected to the lighting device.

8. The optical device according to claim 1, wherein in use, light from the light source is directed through the first end face to the first surface and through the second end face to the second surface.

* * * * *